US007027006B2

(12) United States Patent
Holle

(10) Patent No.: US 7,027,006 B2
(45) Date of Patent: Apr. 11, 2006

(54) APPARATUS AND METHOD FOR MOUNTING A SATELLITE DISH TO A POLE

(75) Inventor: Kevin S. Holle, Parker, CO (US)

(73) Assignee: Echostar Technologies Corporation, Englewood, CO (US)

( * ) Notice: Subject to any disclaimer, the term of this patent is extended or adjusted under 35 U.S.C. 154(b) by 6 days.

(21) Appl. No.: 10/949,617

(22) Filed: Sep. 23, 2004

(65) Prior Publication Data

US 2005/0093763 A1 May 5, 2005

Related U.S. Application Data

(60) Provisional application No. 60/560,733, filed on Sep. 24, 2003.

(51) Int. Cl.
*H01Q 1/12* (2006.01)

(52) U.S. Cl. ..... 343/878; 343/891

(58) Field of Classification Search ..... 343/878, 343/880, 890, 891
See application file for complete search history.

(56) References Cited

U.S. PATENT DOCUMENTS

| | | | | |
|---|---|---|---|---|
| 5,617,680 | A * | 4/1997 | Beatty | 52/27 |
| 5,886,673 | A * | 3/1999 | Thomas | 343/882 |
| 6,396,459 | B1 * | 5/2002 | Pullman | 343/878 |
| 6,727,861 | B1 * | 4/2004 | Antoine | 343/878 |
| 6,731,250 | B1 * | 5/2004 | Berman | 343/878 |
| 6,734,830 | B1 * | 5/2004 | Bickham | 343/880 |

* cited by examiner

*Primary Examiner*—Shih-Chao Chen
(74) *Attorney, Agent, or Firm*—Merchant & Gould P.C.

(57) ABSTRACT

The present invention is a method and apparatus to mount a satellite dish to a pole. This apparatus allows the mounting of a satellite dish without attaching the dish to the user's home or business.

12 Claims, 4 Drawing Sheets

APPARATUS AND METHOD FOR MOUNTING A SATELLITE DISH TO A POLE

This application claims the benefit of Provisional Application No. 60/560,733 filed Sep. 24, 2003.

FIELD OF THE INVENTION

The present invention relates to the mounting of satellite dishes and corresponding hardware. More specifically, the invention relates to the mounting of a satellite dish to a pole using an apparatus that adjusts to the diameter of the pole.

BACKGROUND OF THE INVENTION

Prior art relates to satellite television systems. These systems normally include a television converter and some related equipment. The related equipment may include the satellite dish, feedhorn, and low-noise block filter. To receive the satellite signal the satellite dish and corresponding equipment must be correctly mounted and pointed.

The prior art also includes various apparatuses to mount satellite dishes that receive television signals. Such prior art devices may include four parts. These parts are the foot, the mast, the dish, and the feedhorn. Installation of prior art satellite dishes may involve attaching the foot to the structure of the user's home or business, anchoring the mast to the foot, and placing the satellite dish and feedhorn on the mast.

The mounting of a satellite dish to a home may entail attaching the foot to a house. For a home installation of a satellite dish on the home's roof, the foot may be anchored above the shingles and into the roof truces. Mounting the foot on the side of the house may require the anchoring of the foot to the siding of the house. Essentially, the foot may be screwed to the framing of the home. These screws may penetrate the siding or sheathing of the house and anchor into a wooden stud.

Businesses often have different physical structures. For instance, the building may be made of masonry or made from a steel frame. These building often have different exterior finishes, such as stucco. Many businesses may have flat roofs that may be sealed with tar or a polyurethane membrane.

Following a similar procedure, mounting a satellite dish to a business structure may also involve anchoring the foot to the building. The foot may be screwed or bolted to the framing of the building. The mounting may be on the side or roof of the building.

Secure mounting of the satellite dish is essential to the function of the system. Satellite systems typically require line-of-sight pointing at one or more satellites. If a satellite dish is not pointed at a satellite, the signal may be lost. Thus, keeping the satellite dish steady and secured is important to the customer receiving the signal.

Satellite dishes may also undergo wind loading. Wind loading occurs when movement in the air pushes on the satellite dish. The commonly oval or circular shape of a satellite dish may be susceptible to wind loading. Wind loading may make the satellite dish sway or rock. Again, this type of movement may cause a loss of signal. Thus, the mounting of the satellite dish must be secure enough to overcome wind loading.

Unfortunately, subscriber structures may not provide a sufficient anchor for a satellite dish. If mounted on these type of buildings, a satellite dish may become dislodged, fall down or move excessively. In these situations, the subscriber may lose their signal. Some mountings of the satellite dish may also cause damage to the building. For instance, drilling holes through a flat roof may create leaks in the roof. Anchoring to stucco may cause chipping of the stucco. Essentially, there are times when mounting to the building is either unwise or impossible.

Thus, there exists a need to provide a mount for the satellite dish that does not require attachment to the structure of the home or business. These and other deficiencies of the prior art are overcome by the present invention.

BRIEF SUMMARY OF THE INVENTION

The present invention is a method and apparatus to mount a satellite dish to a pole. This apparatus allows the mounting of a satellite dish without attaching the dish to the user's home or business. Other features and advantages of the present invention will become apparent from the following detailed description of the invention and the accompanying drawings.

Figure 1:
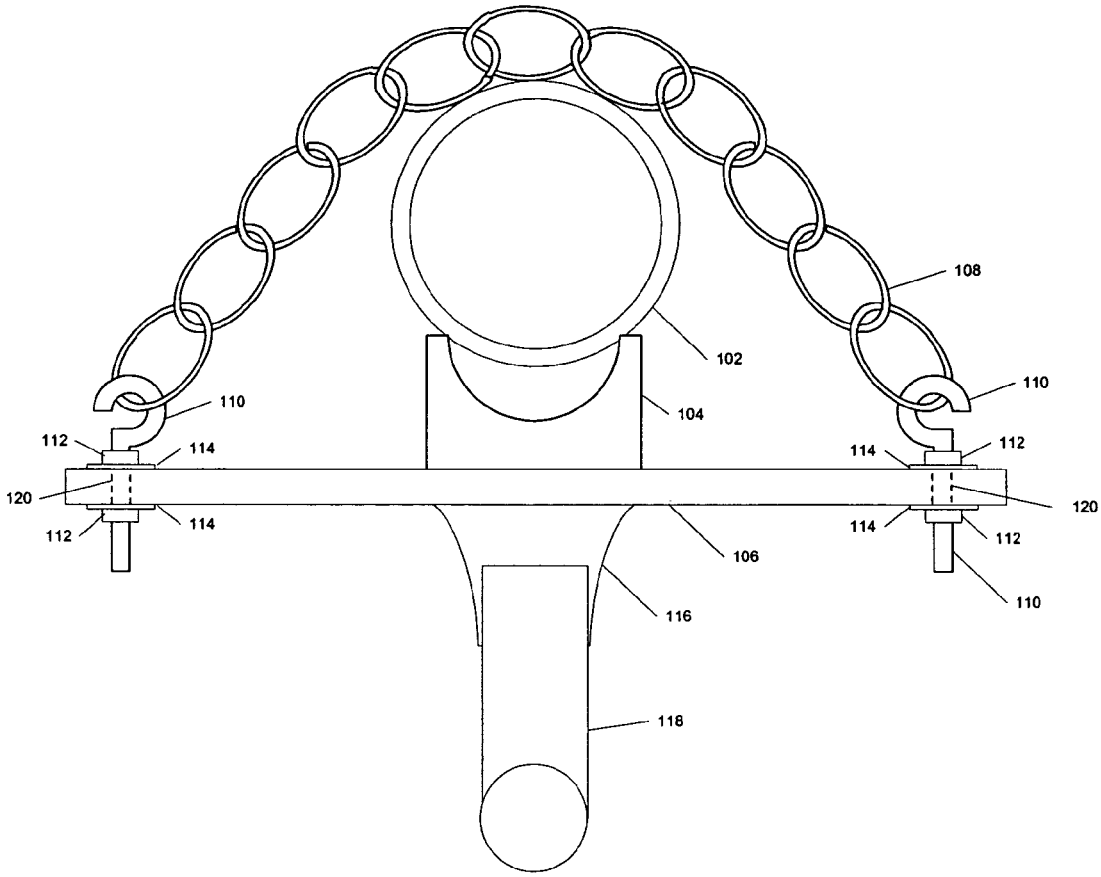
FIG. 1 is a top view of the apparatus for installing a satellite dish to a pole in accordance with an embodiment the present invention.

For clarification, the drawings use a nomenclature for reference numerals that has two parts. The first part of the reference numeral is the drawing number, and it is followed by the second part, a two digit identifier (drawing 1 uses 1*xx*; drawing 3 uses 3*xx*). For example, two reference numerals in drawing 1 may be "102" and "104." A reference numeral in one drawing may be referred to in subsequent drawings; the same reference numeral in later drawings refers to the same item.

DETAILED DESCRIPTION OF THE INVENTION

Figure 2:
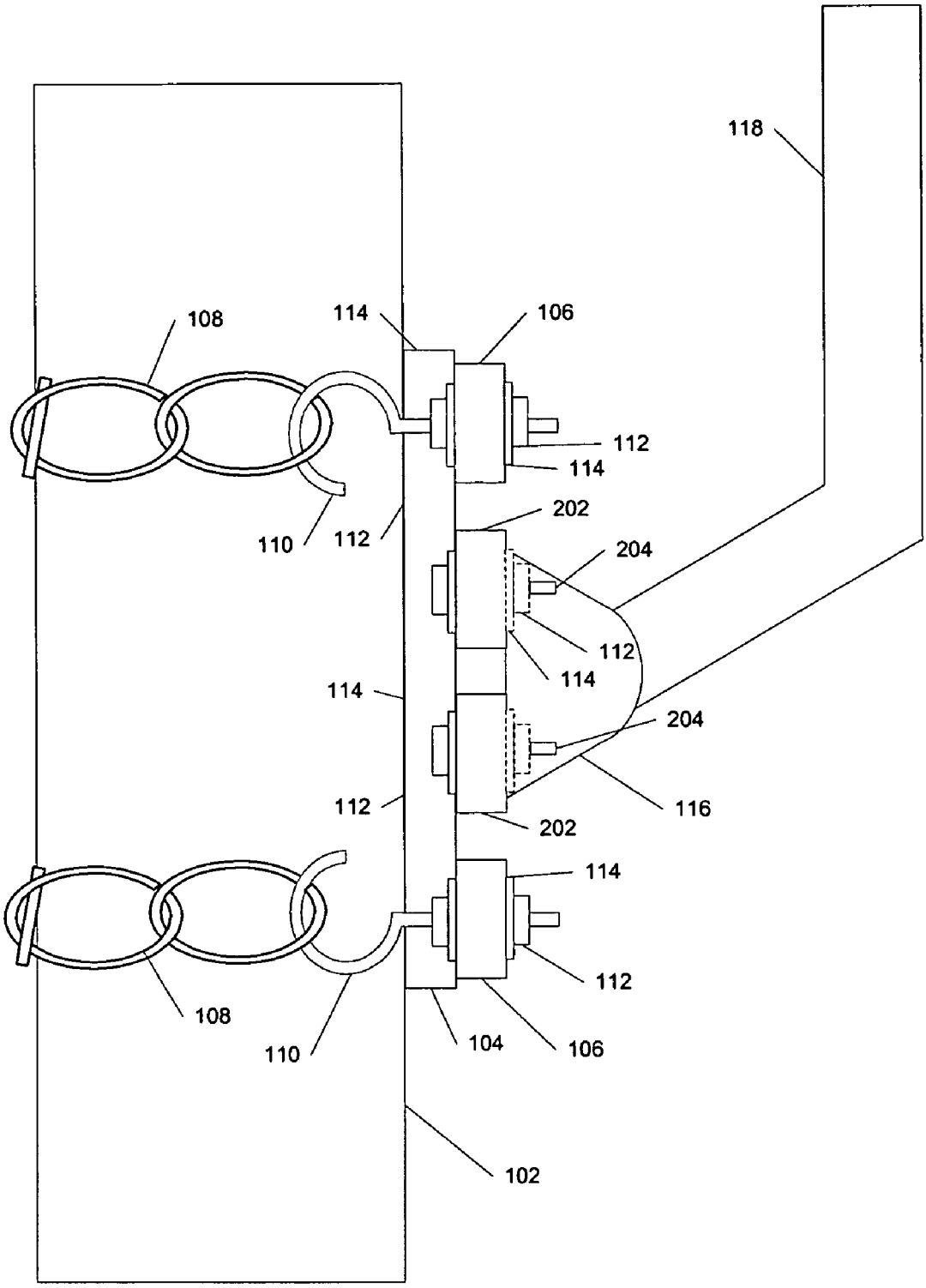
FIG. 2 is a side view of the apparatus for installing a satellite dish to a pole in accordance with an embodiment the present invention.
Figure 3:
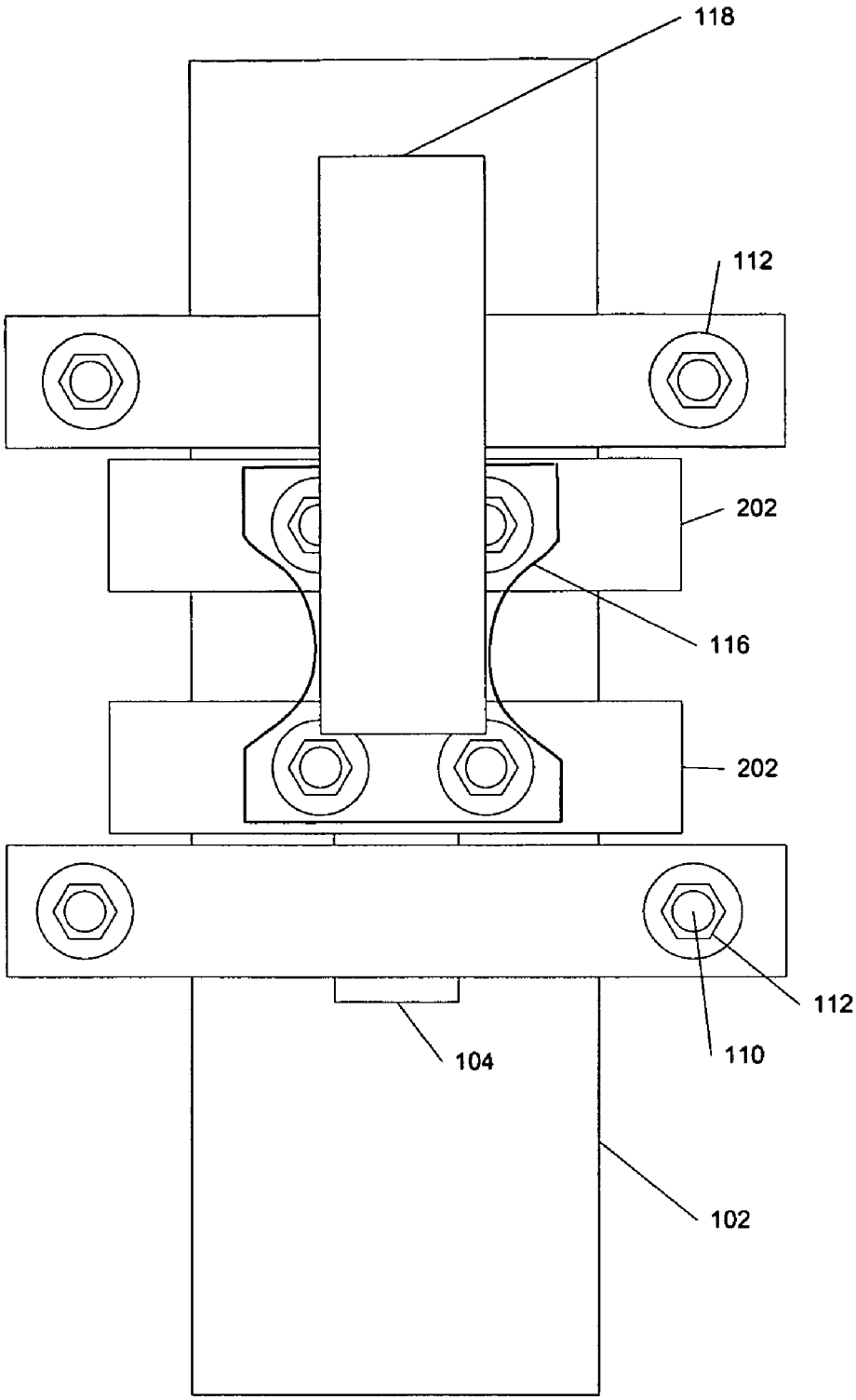
FIG. 3 is a front view of the apparatus for installing a satellite dish to a pole in accordance with an embodiment the present invention.
Figure 4:
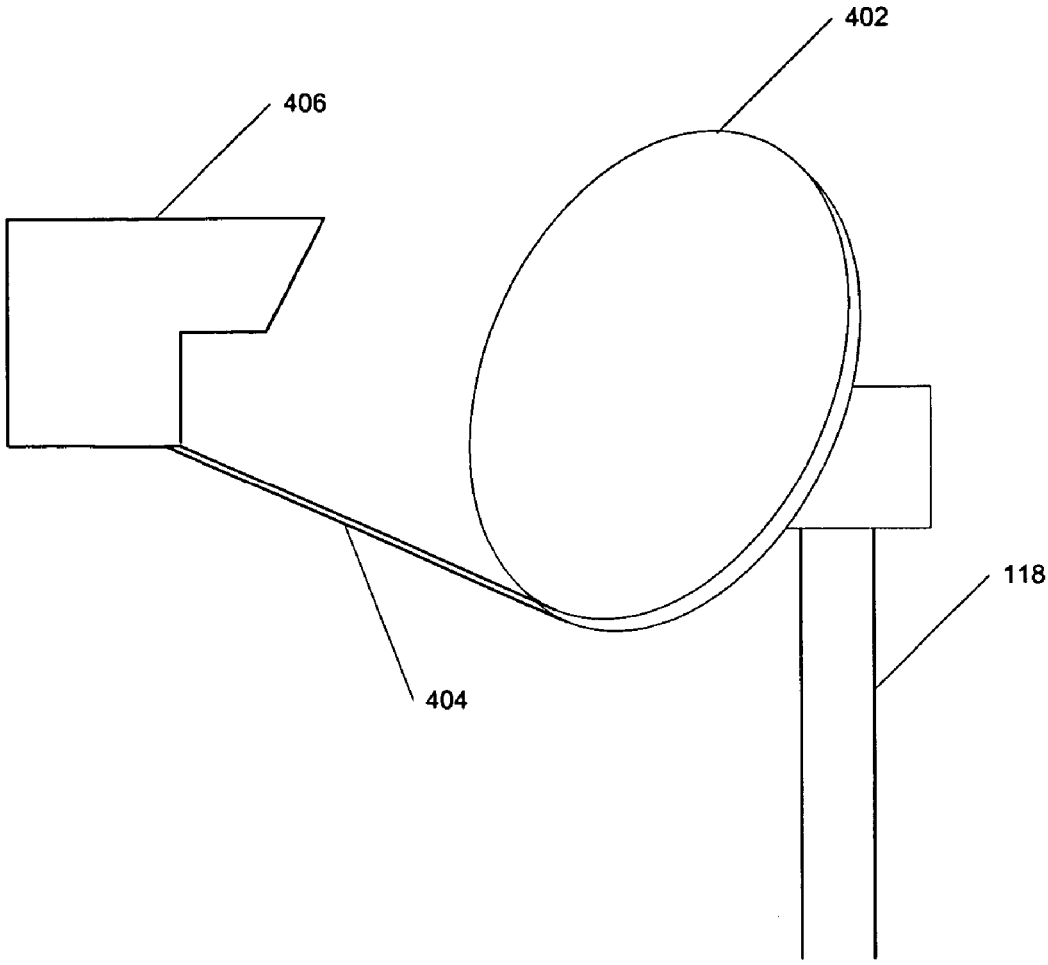
FIG. 4 is a side view of satellite dish antenna that is connected to a mast of the apparatus in accordance with an embodiment of the present invention.

The present invention includes an apparatus and a method to mount satellite dishes onto poles. FIGS. 1–3 show the mounting apparatus. FIG. 1 shows a top-down view, FIG. 2 shows a side view, and FIG. 3 shows a front view of the apparatus. FIG. 4 shows a side view of satellite dish antenna that is connected to the mast of the mounting apparatus.

As set forth by the preferred embodiment of the present invention, the apparatus may include a vertical member 104, one or more cross members 106, one or more chains 108, and one or more dish mount mates 202. The different components of the apparatus may be made from various materials, such as plastics, graphite, and aluminum. Preferably, the components would be made from steel.

In this preferred embodiment, the vertical member is placed against the pole 102 in a lengthwise orientation. This orientation is best seen in FIG. 2. The vertical member 104 may be flat or have another shape. In a preferred embodiment, the vertical member 104 may have a concave back. This concave shape of the vertical member 104 provides two ridges that contact the curved surface of the pole. Thus, the two ridges may provide a stable contact against the pole and may prevent rolling of the vertical member 104. One skilled in the art will recognize that the vertical member 104 may include other forms to help provide a stable contact against the pole, including, but not limited to, a rubberized or metallic treaded back or adhesives.

One or more cross members 106 may be connected to the vertical member 104. The cross members 106 may be welded to the vertical member 104. One skilled in the art will recognize that bolting, gluing, or other attachment of the cross member 106 may be possible. While the cross member 106 may be designed with different shapes, the rectangular beam may be the simplest shape to make or use. The cross member 106 should be of sufficient length to allow the chain 108 to be attached and wrapped around the pole 102. In the drawings, the cross member 106 is shown at the ends of the vertical member 104. However, the placement of the cross members 106 may be at any point along the length of the vertical member 104. A perpendicular orientation to the vertical member 104 is also preferred, but not required.

In a preferred embodiment, a chain 108 is attached to the cross members 106. The chain 108 may be attached using eye bolts 110. One skilled in the art will recognize that other ways of attaching the chain 108 to cross members 106 are possible, including, but not limited to, using quick link threaded fasteners to connect a chain to an eye bolt. The eye bolts 110 may be inserted through holes 120 placed in the cross member 106. A washer 114 and bolt 112 may be placed on one or more sides of the cross member 106 to hold the eyebolt 110. The depth of insertion of the eye bolt 110 may be adjusted. Adjustment may be accomplished by changing where the bolts 112 are placed along the eyebolt 110. If the eyebolt 110 needs to be inserted further into the cross member 106, the bolts 112 may be screwed further up the shank of the eyebolt 110. Thus, by adjusting the eyebolt 110, the chain 108 may be tightened. Having two eyebolts 110 may allow for the chain 108 to be tightened or loosened to a greater extent. However, in another embodiment, one end of the chain 108 may be welded or attached without an eyebolt 110.

In a preferred embodiment, the chain 108 is wrapped around the pole 102. Thus, the chain 108 may span the opposite side of the pole 102 from the vertical member 104. In this way, the pole 102 is between the vertical member 104 and the chain 108. When the chain 108 is tightened, a force pulls the vertical member 104 against the pole 102. The vertical member 104 is held in place by friction.

To mount the foot 116 of the satellite dish in this preferred embodiment, the apparatus includes a dish mounting mate 202. The dish mounting mate 202 may be a plate that can mate with the foot 116. In the drawings, the mate comprises a pair of two mounting members 202. These mounting members 202 may be separated by a sufficient distance to accommodate the satellite foot 116. Bolts 204 that are used to attach the foot 116 to the mounting members 202 may be inserted through the mounting members 202 and nuts 112. The foot 116 may then hold the mast 118, which secures the satellite dish 402, feedhorn 404, and low noise block filter (LNBF) 406. One skilled in the art will recognize that fewer, more or different satellite dish components may be secured by the mast 118.

One skilled in the art will recognize that fewer, more or different satellite dish components may be secured by the mast 118. The installation of a satellite dish often requires pointing the satellite dish towards the signals transmitted by one or more satellites. Pointing the satellite dish may require adjusting the azimuth and elevation of the satellite dish. In order to get accurate azimuth and elevation for the satellite dish, the mast 118 must be oriented vertically to the horizon in all directions. To achieve this vertical orientation, in this preferred embodiment, the mast 118 may pivot to achieve vertical orientation with respect to a first axis. Additionally, bolts 204 can be used to achieve vertical orientation with respect to a second axis which is perpendicular to the first. Those skilled in the art will recognize that there are many methods for insuring that mast 118 is vertically oriented with good accuracy. Once the mast 118 is vertically oriented, the satellite antenna can be placed on it. The antenna will be preset with an appropriate elevation and the installer can then swing the antenna through various azimuth angles until the satellite is found.

It will be clear that the present invention is well adapted to attain the ends and advantages mentioned as well as those inherent therein. While a presently preferred embodiment in the form of a satellite mount has been described for purposes of this disclosure, various changes and modifications may be made which are well within the scope of the present invention. For example, a vertical member 104 may also include, but is not limited to, metallic treads, rubberized treads or an adhesive backing. Numerous other changes may be made which will readily suggest themselves to those skilled in the art and which are encompassed in the spirit of the invention disclosed and as defined in the appended claims.

I claim:

1. A satellite dish antenna and mount for attaching a satellite dish to a pole, comprising a. a satellite dish for focusing radio waves from a satellite to a focal point on a low noise block filter (LNBF) attached to the satellite dish by a feedhorn;

b. a vertical member, having a first side and a second side, to be held against the pole on the second side in a parallel orientation with the pole;

c. a plurality of cross members, having a first end and a second end, attached perpendicularly to the first side of the vertical member;

d. a plurality of chains that have a first chain end and a second chain end, wherein the first chain end of a chain is attached to the first end of a cross member and the second chain end of the chain is attached to the second end of the cross member, and wherein the chain is wrapped around the pole so that the pole is between the chain and the vertical member to hold the vertical member against the pole by friction; and, e. a dish mounting mate attached to the first side of the vertical member, wherein the dish mounting member accepts a footing of a satellite dish mast that is attached to the satellite dish.

2. A satellite dish antenna and mount according to claim 1, wherein the first chain end of the chain is adjustably connected to the first end of the cross member to tighten the chain onto the pole.

3. A satellite dish antenna and mount according to claim 1, wherein the dish mounting mate including a first mounting member and a second mounting member and the first mounting member attaches to a first side of the footing and the second mounting member attaches to a second side of the footing.

4. A satellite dish antenna and mount according to claim 1, wherein the dish mounting mate is a plate.

5. A satellite dish antenna and mount according to claim 1, wherein the first chain end attaches to a quick link that hooks to an eye bolt that slides through the cross member and is secured with a nut.

6. A satellite dish antenna and mount according to claim 1, wherein the vertical member has a concave channel running along the length of the second side, wherein the channel forms two ribs that contact the pole.

7. A satellite dish mounting system, comprising:

a. a pole;

b. a pole mating apparatus, secured to the pole using a friction contact, that includes a vertical member, having a first side and a second side, to be held against the pole on the second side in a parallel orientation with the pole;

a plurality of cross members, having a first end and a second end, attached perpendicularly to the first side of the vertical member;

a plurality of chains that have a first chain end and a second chain end, wherein the first chain end of a chain is attached to the first end of a cross member and the second chain end of the chain is attached to the second end of the cross member, and wherein the chain is wrapped around the pole so that the pole is between the chain and the vertical member to hold the vertical member against the pole by friction; and, a dish mounting mate attached to the first side of the vertical member, wherein the dish mounting member accepts a footing of a satellite dish mast;

c. a foot attached to the pole mating apparatus;

d. a mast secured to the foot;

e. a satellite dish attached to the mast;

f. a feedhorn attached to the satellite dish; and g. an LNBF attached to the feedhorn.

8. A satellite dish antenna and mount for attaching a satellite dish to a pole, comprising a. a pole contact means;

b. a plurality of chain attachment means, attached to the pole contact means;

c. a chain means, attached to a chain attachment means and wraps around the pole to so that the pole is between the chain means and pole contact means to hold the pole contact means to the pole by friction; and, d. a dish mounting means attached to the pole contact means and mates to a satellite dish mount.

9. A method for mounting a satellite dish to a pole, comprising:

a. attaching an apparatus to a pole, wherein the apparatus includes a vertical member, having a first side and a second side, to be held against the pole on the second side in a parallel orientation with the pole;

a plurality of cross members, having a first end and a second end, attached perpendicularly to the first side of the vertical member;

a plurality of chains that have a first chain end and a second chain end, wherein the first chain end of a chain is attached to the first end of a cross member and the second chain end of the chain is attached to the second end of the cross member, and wherein the chain is wrapped around the pole so that the pole is between the chain and the vertical member to hold the vertical member against the pole by friction;

a dish mounting mate attached to the first side of the vertical member, wherein the dish mounting mate accepts the first end of a satellite dish mast having a first end and a second end; and, a satellite dish attached to the second end of a satellite dish mast, wherein the first end of a feedhorn, having a first end and a second end, is attached to the satellite dish and the second end of the feedhorn is attached to an LNBF;

b. mating the satellite foot to the dish mounting mate;

c. mating the satellite dish mast to the satellite dish; and, d. tightening the chains until the apparatus is held against the pole using friction.

10. A method according to claim 9, wherein mating the satellite foot includes bolting the satellite foot to the dish mounting mate.

11. A method according to claim 9, wherein the chain is attached to the cross member with an eye bolt inserted in and bolted to the cross member.

12. A method according to claim 11, wherein the tightening of the chain includes adjusting the depth of insertion of the eye bolt in the cross member.

* * * * *

UNITED STATES PATENT AND TRADEMARK OFFICE

CERTIFICATE OF CORRECTION

PATENT NO. : 7,027,006 B2
APPLICATION NO. : 10/949617
DATED : April 11, 2006
INVENTOR(S) : Kevin S. Holle It is certified that error appears in the above-identified patent and that said Letters Patent is hereby corrected as shown below:

Column 3, line 63, delete

"One skilled in the art will recognize that fewer, more or different satellite dish components may be secured by the mast 118."

Signed and Sealed this

Nineteenth Day of September, 2006

JON W. DUDAS
*Director of the United States Patent and Trademark Office*